US009041279B2

(12) United States Patent
Hoehler

(10) Patent No.: US 9,041,279 B2
(45) Date of Patent: May 26, 2015

(54) PRODUCTION MACHINE HAVING AN OPERATING STATE WARNING LIGHT DEVICE

(75) Inventor: Christian Hoehler, Bad Duerrheim (DE)

(73) Assignee: WERMA Holding GmbH + Co. KG, Rietheim-Weilheim (DE)

( * ) Notice: Subject to any disclaimer, the term of this patent is extended or adjusted under 35 U.S.C. 154(b) by 99 days.

(21) Appl. No.: 13/261,301

(22) PCT Filed: Jul. 27, 2011

(86) PCT No.: PCT/EP2011/003751

§ 371 (c)(1),
(2), (4) Date: Aug. 7, 2012

(87) PCT Pub. No.: WO2012/019705

PCT Pub. Date: Feb. 16, 2012

(65) Prior Publication Data

US 2012/0299467 A1 Nov. 29, 2012

(30) Foreign Application Priority Data

Aug. 10, 2010 (DE) ..... 10 2010 033 939

(51) Int. Cl.
*H05B 33/12* (2006.01)
*H05B 33/00* (2006.01)
*F21S 8/00* (2006.01)

(52) U.S. Cl.
CPC .. *H05B 33/12* (2013.01); *F21S 8/00* (2013.01)

(58) Field of Classification Search
CPC . H01L 51/00; H01L 51/5088; H01L 51/5206; H01L 2251/50; H01L 2251/5361; F21Y 2105/008; F21S 6/00; F21S 8/00; H05B 33/12
USPC ..... 313/504–506
See application file for complete search history.

(56) References Cited

U.S. PATENT DOCUMENTS 4,831,848 A * 5/1989 Arbizzani ..... 68/12.08
6,497,969 B2 * 12/2002 Kim et al. ..... 428/690

(Continued)

FOREIGN PATENT DOCUMENTS

DE 202 01 403 U1 7/2002
DE 102 39 347 A1 3/2004

(Continued)

*Primary Examiner* — Sikha Roy
(74) *Attorney, Agent, or Firm* — Breneman & Georges

(57) ABSTRACT

A production machine (12) is proposed, in particular a machine tool or the like, having a machine housing (13) for at least partially enclosing the production machine (12) and having an operating state warning light device (1) for the optical display of at least one operating state of the production machine (12), in particular of multiple different operating states, wherein at least one warning light element (1) is provided, which is implemented as a light-emitting diode (1) and has a warning light surface, wherein the warning light element (1) is arranged on a carrier layer, wherein the warning light element (1) has at least one luminescent layer, which emits a warning light and is arranged between a first and a second electrode, in particular a cathode and an anode, wherein better perceptibility is achieved than in the prior art. This is achieved according to the invention in that the machine housing (13) at least comprises the warning light element (1), and in that the electrode surfaces of the electrodes substantially correspond to the warning light surface of the warning light element (1), and in that at least one of the electrodes is light-transmitting and/or transparent.

17 Claims, 2 Drawing Sheets

(56) References Cited

U.S. PATENT DOCUMENTS

Figure 1:
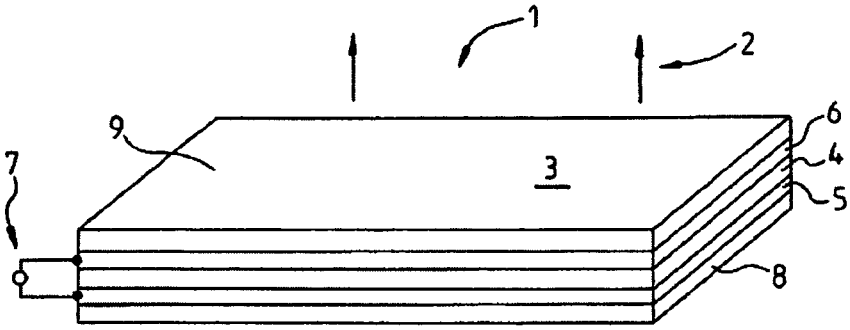

| | | | | |
|---|---|---|---|---|
| 7,965,030 | B2 * | 6/2011 | Frank et al. | 313/501 |
| 2004/0085020 | A1 * | 5/2004 | Handa et al. | 313/511 |
| 2005/0073823 | A1 * | 4/2005 | Engelmann et al. | 362/23 |
| 2006/0043912 | A1 | 3/2006 | Foust et al. | |
| 2006/0201181 | A1 * | 9/2006 | Bauer et al. | 62/264 |
| 2007/0290199 | A1 * | 12/2007 | Ling et al. | 257/40 |
| 2008/0245788 | A1 * | 10/2008 | Choong et al. | 219/758 |
| 2010/0046210 | A1 * | 2/2010 | Mathai et al. | 362/147 |

FOREIGN PATENT DOCUMENTS

| | | | |
|---|---|---|---|
| DE | 10 2005 014 345 | A1 | 10/2005 |
| DE | 10 2005 038 718 | B3 | 8/2006 |
| DE | 10 2007 044 680 | A1 | 4/2009 |
| EP | 2182503 | A1 * | 5/2010 |
| WO | WO 2012/019705 | A1 | 2/2012 |

* cited by examiner

PRODUCTION MACHINE HAVING AN OPERATING STATE WARNING LIGHT DEVICE

The invention relates to a production machine, in particular a machine tool or the like, having a machine housing for at least partially enclosing the production machine and having an operating state warning light device for the optical display of at least one operating state, in particular of multiple, different operating states, of a technical appliance such as a machine, a facility, or the like, having at least one warning light element, which is implemented as a light-emitting diode and has a warning light surface for a production machine, in particular a machine tool or the like, having a machine housing for at least partially enclosing the production machine and having an operating state warning light device for the optical display of at least one operating state of the production machine, in particular of multiple different operating states, wherein at least one warning light element is provided, which is implemented as a light-emitting diode and has a warning light surface, wherein the warning light element is arranged on a carrier layer, wherein the warning light element has at least one luminescent layer, which emits a warning light and is arranged between a first and a second electrode, in particular a cathode and an anode.

PRIOR ART

Up to this point, primarily so-called signal columns have been used as the operating state warning light device for displaying, for example, operating states of production machines such as machine tools, conveyor or transport belts, soldering or welding machines/robots, printing or labeling machines, lacquering or washing units, baking or cooking units, injection molding machines, or the like. The signal columns typically have different colored so-called exchangeable modules, so that the operating personnel or others may easily recognize the proper status or a disturbance or a danger easily thereby.

In recent years, these signal columns have been equipped more and more frequently with multiple light-emitting diodes (LEDs) arranged on both sides of a circuit board.

In addition, a signal column or signal light is already known from DE 102 39 347 A1, which does not have exchangeable modules, but rather a cylindrical warning light matrix having numerous luminescent dots arranged in a matrix. The cylinder is therefore constructed as a so-called matrix display, which is to be implemented using LEDs or organic LEDs (OLED). Using this matrix display or the matrix activation of individual LEDs or luminescent dots, respectively, this signal column can light up in monochrome, on the one hand, or because of the use of different colored LEDs or OLEDs, multicolored luminescent images, for example, letters, characters, or figures, can also be shown.

The dotted or "restless" light surface is disadvantageous in terms of perceiving the optical warning signal, however.

In particular in the case of more complex or larger production machines having numerous indicator lights, display screens, lamps, etc., the warning signal of the signal appliances or signal columns is partially somewhat "lost" and can possibly be overlooked by the personnel.

In addition, the individual warning signal can also be overlooked or mistaken for something else in larger production halls having multiple production machines each having at least one signal appliance. A certain noise level frequently also prevails in such halls, so that even additional acoustic warning signals of the signal appliances are only perceived with difficulty or are also partially not heard.

Object and Advantages of the Invention

The object of the invention is to propose a production machine having an operating state warning light device for the optical display of at least one operating state of the production machine, wherein better perceptibility is achieved than in the prior art.

This object is achieved, proceeding from a production machine of the type mentioned in the introduction, by the characterizing features of claim 1. Advantageous embodiments and refinements of the invention are possible through the features mentioned in the subclaims.

Accordingly, a production machine according to the invention is distinguished in that the machine housing comprises at least the warning light element, and in that the electrode surfaces of the electrodes substantially correspond to the warning light surface of the warning light element, and in that at least one of the electrodes is light-transmitting and/or transparent, and in that at least part of the machine housing is implemented as the carrier layer of the warning light element.

Using this measure the result is achieved that, according to the invention, the production machine is implemented to form the operating state warning light device. A separate signal column or the like becomes superfluous in this way.

The larger the production machine or its housing, the larger the warning light surface can be embodied to be. Correspondingly, according to the invention, a particularly large-dimensioned or large-area warning light surface can be implemented. Warning light surfaces can be produced for each warning color in this case, which are multiple times larger than what was typical up to this point for signal columns. A substantially improved perceptibility is achieved.

In addition, according to the invention, a homogeneous warning light surface is implemented, which, in contrast to the matrix light surfaces or overall warning light surface composed of many individual luminescent dots or LEDs, respectively, is more homogeneous. In addition, better or stronger light-emitting action and therefore perceptibility of the total warning light surface is achieved. As defined in the invention, the warning light surface is understood as the surface of the warning light element through which the warning light exits from the warning light element into the surroundings or the air.

On the other hand, the very complex, separate activation of the individual LEDs or luminescent dots of the light matrix, which is to be provided in the prior art, is dispensed with. Comb-shaped complex electrodes, which are required for the activation of the individual luminescent dots as in the prior art, are also not to be provided.

Rather, according to the invention, electrodes are provided, whose electrode surfaces each substantially correspond to the entire warning light surface of the warning light element, which simplifies their production. Through the light-transmitting or transparent implementation of one of the electrodes, it is possible to arrange it on the outer side or surface of the warning light element, so that the light of the LED can advantageously penetrate through it outward or on the surface, so that it is accordingly noticeable by the operating personnel or others.

According to the invention, an arrangement of the electrodes or the luminescent layer of the light-emitting diode transversely to the emission direction of the warning light or substantially parallel to the surface or to the warning light surface, respectively, is advantageous. A construction according to the invention accordingly results having individual layers which are preferably arranged substantially parallel to one another, wherein a luminescent layer is arranged between two electrode layers and one of the electrodes is light-transmitting and/or transparent.

In contrast, the electrodes are arranged in a typical LED for the matrix-shaped arrangement substantially in the direction of the emission direction of the warning light, between which the luminescent region of the LED is located. This means that the electrodes in a typical LED are arranged next to one another and not advantageously one over another, as in the present invention.

The first and second electrodes are preferably light-transmitting and/or transparent. In this way, it is made possible that, for example, in the case of the advantageous use of a transparent luminescent layer, the entire light-emitting diode according to the invention is invisible to the greatest possible extent or nearly invisible in the deactivated or non-luminescent state. Completely novel possibilities for arranging the warning light element according to the invention result therefrom.

The perceptibility of the light from the warning light is also improved in this way, since the warning light more or less comes from nowhere, so that a surprise effect is also achieved for the operating personnel or for appropriate persons, respectively, which further improves the perceptibility or the signaling.

In addition, the warning light element, which is nearly invisible in the deactivated state, can also advantageously be arranged on transparent or translucent surfaces. For example, the warning light element according to the invention can be arranged on a viewing window of the production machine or machine tool, through which the machinist observes the workpiece or tool processing, for example. In case of warning, this invisible warning light element according to the invention can then light up red, for example, so that a high warning affect or great perceptibility is achieved.

In an advantageous refinement of the invention, the warning light element has at least one second luminescent layer arranged between the second electrode and a third electrode, wherein the electrode surface of the third electrode essentially corresponds to the warning light surface of the warning light element. With the aid of this measure, for example, an advantageous multicolored warning light or a multicolored warning light element can be implemented, wherein the first luminescent layer is implemented differently from the second luminescent layer, so that these emit different warning lights, i.e. in particular different colored warning lights.

Alternatively or in combination with the above-mentioned measure, a multicolored nature may also be implemented in that a different voltage and/or electrical current strength is applied to the luminescent layer.

Through the advantageous transparency or translucency of one or more electrodes, which are aligned in particular toward the surface of the warning light element, the result is advantageously achieved that the light of the lower luminescent layer can also radiate or penetrate through the electrodes or luminescent layers lying above it. A different color is therefore advantageously perceived from the same luminescent element by the operator or the surroundings, respectively. The luminescent regions are not arranged next to one another in this case, as in a matrix-type arrangement of different colored LEDs, but rather one on top of another.

The electrodes and the luminescent layers are preferably arranged substantially parallel to one another or to the warning light surface. For example, a layered construction of electrodes and luminescent layers is provided. In this case, the electrodes or luminescent layers which are oriented outward or oriented toward the surface are advantageously implemented as transparent or light-transmitting. Only the innermost electrode can optionally also be implemented as non-transparent. In the case of a completely transparent or light-transmitting implementation of all electrodes and luminescent layers, a translucent warning light element is produced which, as already mentioned above, is nearly invisible or is not perceived in the deactivated or non-luminescent state.

For example, in the case of a three-color warning light, three different luminescent layers may be provided between two respective, possibly partially identical electrodes. A combination of the colors can optionally also be implemented by the simultaneous activation of two or more different luminescent layers, so that arbitrary or innumerable color tones can be generated. This is generated, for example, in typical multicolor LEDs constructed like a matrix by combination of red, green, and blue light or luminescent dots. According to the invention, this color variation or color combination can be generated by, for example, three different luminescent layers arranged one on top of another.

The warning light surface and/or the electrode surface is advantageously at least 1 $m^2$, in particular multiple square meters in size. Particularly strong perceptibility is achieved by this large-area implementation of the warning light. For example, 2 $m^2$ warning lights or even larger warning lights are certainly implementable according to the invention. Because of this particularly large-area size of the operating state warning light device according to the invention, which goes well beyond the previous dimensions, particularly good perceptibility of the operating state to be indicated is also achieved. This significantly exceeds previous dimensions of signal columns or the like.

In a special variant of the invention, one side of the machine housing, e.g., a front side, is implemented essentially entirely as an operating state warning light device according to the invention. For example, not only a planar or flat surface of the machine housing can be provided as the operating state warning light device here. Rather, a three-dimensional surface or a structured, curved, or angled machine housing surface can certainly also be implemented as an operating state warning light device according to the invention.

A window of the machine housing is preferably implemented as an operating state warning light device according to the invention. It is particularly advantageous in this case if the operating state warning light device is nearly completely transparent or light-transmitting in the nonluminescent or deactivated state.

It is fundamentally advantageous that the warning light element can have arbitrary shapes and/or is flexible in an advantageous manner, so that it can be adapted to arbitrary shapes, for example, of the machine housing of the production machine, e.g., of a machine tool.

The operating state warning light device and/or the warning light element is preferably fixed on the machine housing, for example, glued onto the machine housing or implemented as a coating of the machine housing. For example, the warning light element or the various layers of the warning light element, such as electrodes and/or luminescent layers, can be applied by means of advantageous spraying and/or vapor deposition methods and/or as a lacquer or the like to advantageous points or to advantageous regions of a machine housing.

So-called topcoat methods can also be provided in this case, for example. A particularly flexible or multifaceted arrangement of the warning light element on advantageous points and/or a large-area implementation of the warning light according to the invention is implementable in this way. In addition, this is also implementable in an economically advantageous manner.

Exemplary Embodiment

An exemplary embodiment of the invention is illustrated in the drawings and will be explained in greater detail hereafter on the basis of the figures.

Figure 2:
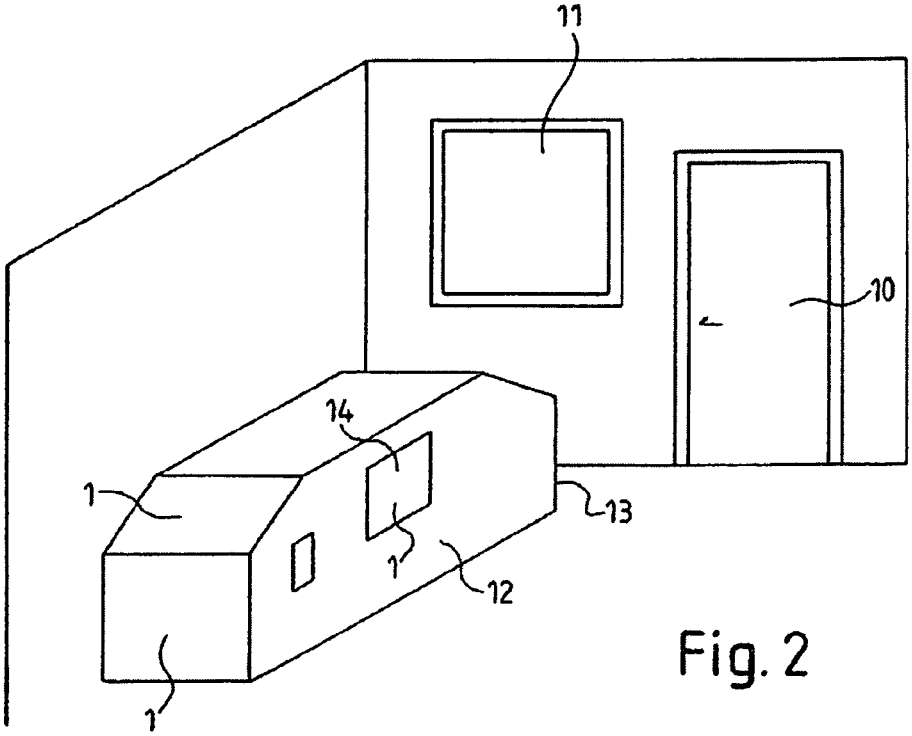
Figure 1A:
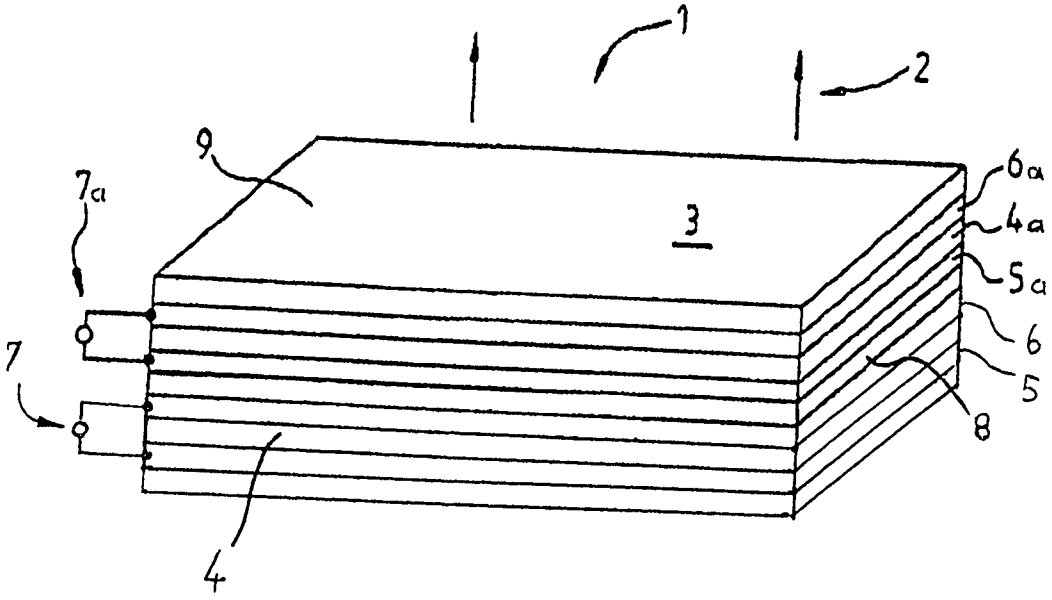

In the detailed figures:

FIGS. 1 and 1A show a schematic layered construction of a warning light element according to the invention on a machine housing of a production machine according to the invention and FIG. 2 shows a schematic view of a production space having a production machine according to the invention having a warning light element on the machine housing.

FIG. 1 schematically shows a warning light element 1 according to the invention. Warning light 2 is emitted from a warning light surface 3 in this case, which light is emitted from a luminescent layer 4 of an organic light-emitting diode (OLED). Two electrodes 5 and 6 are arranged on both sides of the luminescent layer 4 and each have an electrode surface, which corresponds to the warning light surface 3. This means that the luminescent layer 4 is arranged between a first and a second electrode 5, 6. An electrical current/voltage is applied to the electrodes 5, 6. This is symbolically shown by an electrical current or voltage supply 7.

In addition, a base layer 8 and/or a cover layer can advantageously be provided, which ensure the mechanical strength, on the one hand, and/or are implemented as the carrier for the other layers 4 to 6. For example, the cover layer 9 can also be provided as a protective layer or as a seal, to protect the partially sensitive luminescent layers 4 of an OLED.

According to the invention, the base layer 8 is arranged or fixed on a machine housing or the base layer is implemented as the machine housing. In the last-mentioned advantageous variant, a separate base layer of the warning light element 1 can be omitted. Fundamentally, the base layer 8 can be implemented as a mechanically stable or supporting carrier or support layer, which can also be taken over by the machine housing in the above-described corresponding variant. That is to say, according to the invention, the machine housing is additionally implemented as the carrier or support layer in this case. The design and production expenditure is accordingly decreased by the double function of the machine housing according to the invention.

In addition, further layers, e.g., possibly an electrically conductive intermediate layer having a third electrode 5*a* with a further luminescent layer 4*a* and a further electrode 6*a* is illustrated in FIG. 1A which can be provided between the luminescent layer 4 and an electrode 5 or 6. A further electrical current or voltage supply 7*a* may also be provided for the electrodes 5*a* and 6*a* to supply second luminescent layer 4*a*.

Fundamentally, it is advantageous to implement the individual layers 4, 5, 6, 8, 9 as flexible, for example, so that a flexible warning light element 1 implemented as a film or the like can be produced. This can be adapted to arbitrary geometric shapes or surfaces, for example. The warning light or the warning light element 1 can thus also be adapted and/or glued or attached onto angled, bent, or structured or three-dimensionally implemented machine housings.

FIG. 2 schematically shows a production space having a door 10 and a window 11 and having a production machine 12, which has a machine housing 13, for example, which has multiple individual housing sides. For example, two individual surfaces of the machine housing 13 are implemented as warning lights 1 according to the invention in FIG. 2.

Alternatively or in combination therewith, a window 14 of the machine housing 13 can also be implemented as a warning light or warning light element 1 according to the invention. Through this viewing window 14, for example, an operator can observe the production or the workpiece processing. For example, in the event of damage to the tool, according to the invention, the viewing window 14 can advantageously light up and/or flash in colors.

For example, a part, e.g., only one of the warning lights 1 of the machine housing 13 lights up yellow in the event of an empty magazine. In the event of a possible disturbance or in case of fire, for example, of the production machine 12, multiple or even all warning lights 1 of the production machine 12 light up red. In this way, particularly high perceptibility of corresponding operating states and/or hazard states is achieved. This means a substantially higher perceptibility than was previously possible by means of signal columns or the like, which were attached or fixed on top on the housing 13 of the production machine 12, for example.

Fundamentally, according to the invention, the warning lights or warning light elements 1 can be glued or attached, for example, as a film, onto already existing surfaces of the machine housing 13, such as front sides, housing doors, windows 14, or the like. In this case, the machine housing 13 would be separate from the base layer 8 of the warning light element 1.

The various layers 4, 5, 6, 8, 9 of the warning light 1 according to the invention can optionally also already be applied by means of greatly varying application methods during the production of corresponding components of the machine housing, etc. For example, spraying, printing, and/or vapor deposition methods may be provided for this purpose. For example, a topcoat method or a lacquering method can be provided. In this case, the machine housing 13 could optionally be implemented as the base layer 8 of the warning light element 1.

In addition to the advantageous, partially very large-area warning lights 1 according to the invention, preferably large-area warning lights can also be attached to further surfaces of the production space or a production building and/or warning lights having a matrix construction can also be provided, in order to additionally also display text information, characters, images, or the like, for example.

LIST OF REFERENCE NUMERALS

1 warning light element
2 light
3 warning light surface
4 luminescent layer
5 electrode
6 electrode
7 power supply
8 layer
9 layer
10 door
11 window
12 machine
13 housing
14 viewing window

What is claimed is:

1. In a production machine having a machine housing for at least partially enclosing the production machine and having an operating state warning light device for the optical display of at least one operating state from a plurality of operating states of the production machine wherein the improvement comprises the machine housing having a first part and a second part and the first part or second part of the machine housing forms a carrier layer for a warning light element in which the warning light element has at least one homogeneous luminescent layer arranged between first and a second electrodes, of the warning light element that forms the first part or second part of the machine housing to provide a homogeneous light surface on the machine housing and wherein at least one of the first or second electrodes is light-transmitting and/or transparent and a device to activate different colors over the entire surface of the first part or the second part of the machine housing in response to an operating state of the production machine.

2. The production machine as claimed in claim 1 wherein the first and the second electrodes are light-transmitting and/or transparent.

3. The production machine as claimed in claim 1 or 2 wherein the at least one homogeneous luminescent layer is transparent.

4. The production machine as claimed in claim 1 or 2 wherein the light element is a light-emitting diode or is an organic light-emitting diode.

5. The production machine as claimed in claim 1 wherein the warning light element has at least one second luminescent layer arranged between the second electrode and a third electrode, wherein the electrode surfaces of the third electrode corresponds to a warning light surface of the warning light element.

6. The production machine as claimed in claim 5, wherein the third electrode is light-transmitting and/or transparent.

7. The production machine as claimed in claim 1 wherein the warning light surface and/or the electrode surfaces are at least one square meter in size.

8. The production machine as claimed in claim 1 or 2 wherein the warning light surface and/or the electrode surfaces have a three-dimensional surface or a structured and/or curved and/or angled surface of the machine housing.

9. A machine having a multiple of different operating states comprising:

(a) a housing to at least partially enclose a machine, said housing having a first part and a second part;

(b) a carrier layer or a base layer disposed on said first part or said second part of said housing;

(c) a warning light luminescent layer or base layer disposed on said carrier layer having a warning light element to provide a warning light homogeneous light surface on the machine;

(d) a first and second electrode connected to said warning light luminescent layer or warning light element wherein at least the first or second electrode is light-transmitting and/or transparent; and (e) an electrical current or power supply to illuminate the warning light luminescent layer or base layer of the first part or second part of the housing to illuminate the warning light homogeneous light surface of the machine in different colors based on the operating state of the machine.

10. The machine of claim 9 wherein the carrier layer is a first part or second part of a housing of an existing machine and the warning light luminescent layer and the first and second electrode are flexible film layers attached to the first part or second part of said housing.

11. The machine of claim 10 wherein said first part of said machine housing is a viewing window in the machine housing and the warning light luminescent layer or base layer and first and second electrodes are transparent or light transmitting in the nonluminescent or deactivated state.

12. The machine of claim 11 wherein the viewing window in the machine housing lights up red in a hazard state.

13. The machine of claim 9 further comprising a cover layer or a protective seal.

14. The machine of claim 9 further comprising a third electrode and a second warning light luminescent layer and warning light element arranged between the second electrode and the third electrode.

15. The machine of claim 14 wherein the warning light homogeneous light surface of the machine is activated by the electrical current or power supply to generate different color tones corresponding to an operating state of the machine.

16. A machine for producing a product having a plurality of different operating states comprising:

(a) a housing to at least partially enclose a machine, said housing having a flexible film warning light area covering all or a part of the housing of the machine;

(b) a curved or angled three dimensional surface with a homogeneous luminescent warning light surface which is nearly invisible in a deactivated state and produces different color surfaces on all or part of the housing in an activated state;

(c) a first and second electrode layer connected to the homogeneous luminescent warning light layer wherein at least the first or second electrode layer is light transmitting and/or transparent as disposed in the flexible film or flexible base layer;

(d) a flexible cover for covering the carrier layer or the flexible base layer and the first and second electrode layer; and (e) an electrical current or power supply to illuminate the homogeneous luminescent warning light surface covering all or part of the housing of the machine to produce different color surfaces dependent on an operating state of the machine.

17. The machine for producing a product having a plurality of different operating states of claim 16 wherein the homogeneous luminescent warning light surface includes a light emitting diode or an organic light emitting diode.

* * * * *